United States Patent [19]

Cappelli

[11] 4,221,383

[45] Sep. 9, 1980

[54] SPORTS RACKET

[76] Inventor: Nini P. Cappelli, 8902 Beverly Blvd., Los Angeles, Calif. 90048

[21] Appl. No.: 937,087

[22] Filed: Aug. 28, 1978

[51] Int. Cl.[3] ..... A63B 49/02

[52] U.S. Cl. ..... 273/73 C; 273/73 R

[58] Field of Search ..... 273/73 R, 73 D, 73 C, 273/73 G, 73 H, 73 J, 73 K, 75, 76

[56] References Cited

U.S. PATENT DOCUMENTS

| | | | |
|---|---|---|---|
| D. 164,883 | 10/1951 | Schmid | 273/76 |
| 335,656 | 2/1886 | Taylor | 273/73 R |
| 3,515,386 | 6/1970 | Mason | 273/73 R |
| 3,545,755 | 12/1970 | Owada | 273/73 J |
| 4,147,348 | 4/1979 | Lee | 273/73 C |
| 4,155,550 | 5/1979 | Planakis | 273/73 C |

FOREIGN PATENT DOCUMENTS

| | | | |
|---|---|---|---|
| 358586 | 9/1922 | Fed. Rep. of Germany | 273/73 R |
| 2447415 | 8/1976 | Fed. Rep. of Germany | 273/73 R |
| 582510 | 12/1924 | France | 273/73 G |
| 1380392 | 10/1964 | France | 273/73 J |
| 7607209 | 1/1978 | Netherlands | 273/73 C |
| 11067 | of 1912 | United Kingdom | 273/73 R |

*Primary Examiner*—Charles E. Phillips

*Attorney, Agent, or Firm*—Romney, Schaap, Golant, Disner & Ashen

[57] ABSTRACT

This invention relates to a new and improved sports racket having head, neck and handle portions where the head portion is in a plane different from but parallel to the handle portion so that a player's form, power and timing may be significantly improved without special training.

2 Claims, 4 Drawing Figures

SPORTS RACKET

BACKGROUND OF THE INVENTION

1. Field of the Invention

This invention relates to a sports racket, and, more particularly, to a tennis or similar racket having head, neck and handle portions where the head portion is in a plane different from but aprallel to that of the handle portion and at a specific distance to greatly improve power, form and timing.

2. Description of the Prior Art

Various proposals have been advanced in the art to improve tennis or similar type rackets, and in some cases, to modify the corresponding game as well. Reference may be had to British Pat. No. 11,067 to Van Zscherlitzky which discloses four variations of a tennis racket, all having a pouch attached on or near the racket head portion and used to catch the ball so as to vary the usual game as now played. This reference, particularly in FIG. 2, illustrates a head and a handle in different parallel planes. However, the attachment of the pouch, the very short neck used for changing planes from the head to the handle, and the lack of specific dimensions clearly fail to teach the invention herein. Von Zscherlitzky's specification clearly indicates an intent to vary the game rather than to improve a player's performance in terms of form, power and timing in the normal or usual play of the game.

Reference is also drawn to U.S. Pat. No. 3,545,755 to Owada, British Pat. No. 1929, and German Pat. No. 2447415, all of which disclose variations from the standard racket design consisting either of a twisted handle or head or a major design variation for allowing play of different types of games.

SUMMARY OF THE INVENTION

The above-mentioned facets and problems in the prior art are overcome by the present racket invention which intends to improve a player's overall performance in terms of better form, more power and better timing by placing the head portion of the racket in a different plane at a predetermined distance relative to the handle portion.

An aim of the present invention is to provide means for a player with only average ability to achieve better natural form without special training.

Another aspect of the present invention is to provide means for a player with only average ability to obtain more power in serving and in using his or her forehand and backhand without special training.

A further objective of the present invention is to provide means for a player with only average ability to obtain better timing without special training.

Yet another aspect of the present invention is to provide a racket with an offset head portion relative to the handle portion for providing more power, better form and optimum timing when playing tennis in the usual manner.

Additional objects, purposes and advantages of the invention will be apparent to those skilled in the art in view of the following description of preferred embodiments of the invention.

DESCRIPTION OF THE PREFERRED EMBODIMENTS

Figure 1:
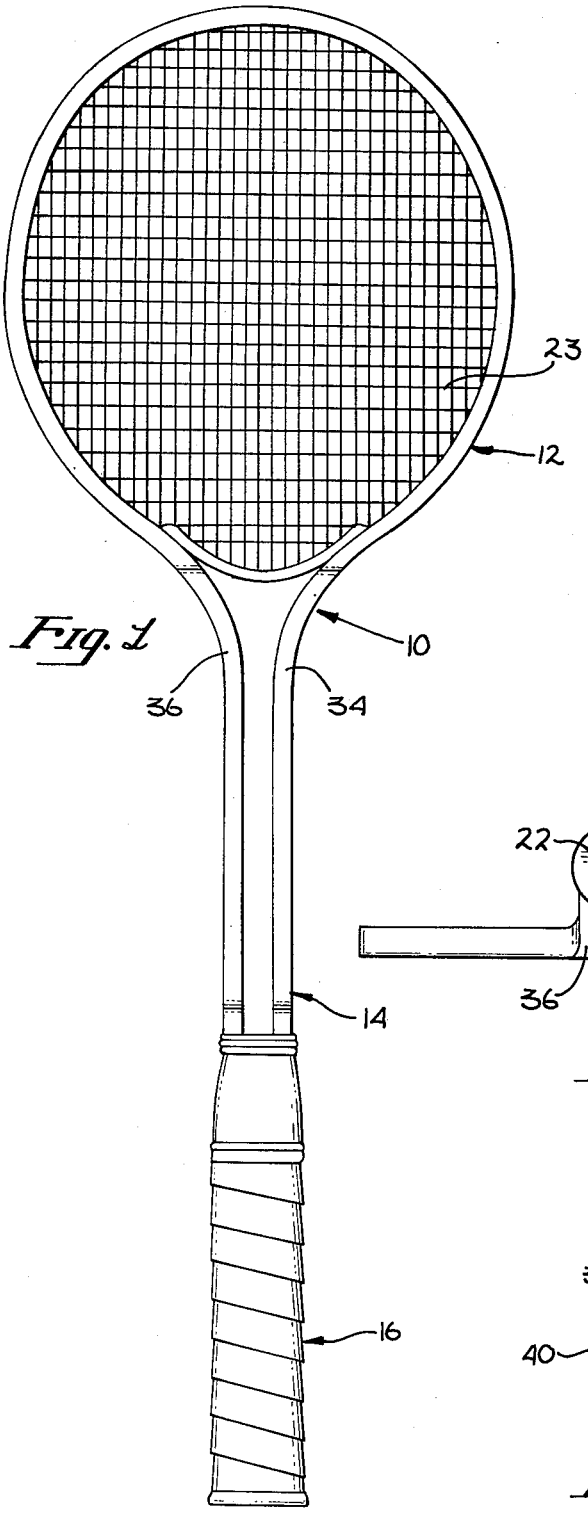
FIG. 1 is a side elevational view of a tennis racket.

While the present invention is susceptible of various modifications and alternative constructions, two embodiments are shown in the drawings and will herein be described in detail. It should be understood, however, that it is not the intention to limit the invention to the particular forms disclosed, but, on the contrary, the intention is to cover all modifications, equivalences and alternative constructions falling within the spirit and scope of the invention as expressed in the appended claims.

Figure 2:
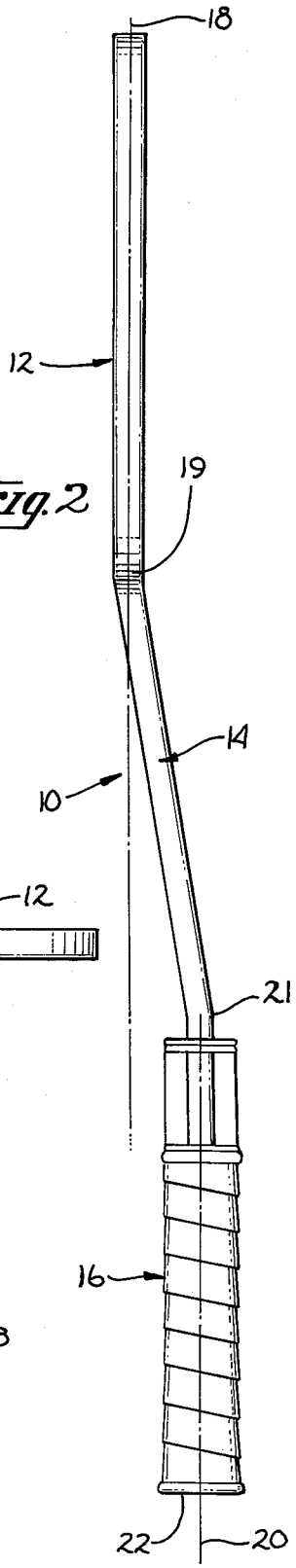
FIG. 2 is a top plan view of the racket of FIG. 1.
Figure 3:
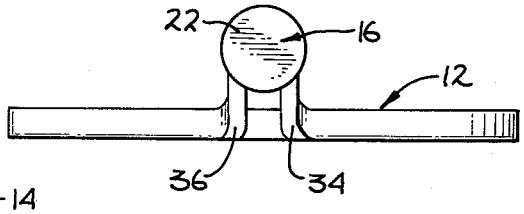
FIG. 3 is an end elevational view of the racket of FIG. 1.

Referring now to FIGS. 1, 2 and 3, there is illustrated a tennis racket 10 having a head portion 12, a neck portion 14, and a handle portion 16. As best seen in FIG. 1, the head portion forms a plane which is represented by a center line 18 while the center line for the handle portion is represented by a line 20.

As can be readily seen, the head portion is offset or spaced from the handle portion, preferably by $1\frac{5}{8}''$, though it has been found that this spacing can be within the range of $1\frac{1}{4}''$ to $2''$ without affecting the results in any substantial way. This spacing is accomplished by sloping the neck portion in a predetermined manner to achieve the desired spacing. As shown in FIG. 1, the slope is created by bending the neck in two locations designated 19 and 21. In existing tennis rackets, the head, neck and handle portions are aligned, that is, their center lines coincide.

In a preferred embodiment, the length of the handle portion is $7\frac{3}{4}''$. The length of the sloped neck portion 14 between points 19 and 21 is just less than $8''$, its slope about $12°$, its linear distance is $7\frac{3}{4}''$ (i.e., the distance measured parallel to lines 18 and 20) while the neck portion between point 21 and the handle portion is $\frac{1}{2}''$ in length. This embodiment has been tested and found to provide to a player better form, more power, and better timing in the game of tennis.

Once again referring to FIGS. 1–3, in a preferred embodiment the dimensions of the handle portion is $1\frac{5}{8}'' \times 1\frac{1}{2}''$ at the base designated 22. The thickness of the head portion is $\frac{1}{2}''$ while its length is $11''$ and width $9''$. As can be readily seen in FIG. 2, the head is of the traditional rounded shape and includes faces, such as face 23, of interlacing "strings" usually made of catgut, nylon or other synthetic material. It can be appreciated that because the neck portion is sloped there will be a slightly greater amount of material used and therefore a slight increase in the weight of the racket, assuming all other factors are equal. In addition, there is a slight change in the position of the center of gravity toward the handle portion and the slight change of the center of percussion, also towards the handle portion. For definitional purposes, the center of percussion or center of oscillation is defined as that point where the mass of a physical pendulum may be considered to be concentrated in determining its period of vibration or in determining whether an impulsive force is exerted on a pivot point when a force is felt at the center of percussion.

By virtue of having the head portion 12 spaced or offset from the handle portion 16, a moment arm is created for the weight of the head portion relative to the handle portion. The product of the moment arm and the weight is equal to a force which acts upon the players arm as will be described in more detail hereinbelow. It should be noted, however, that there is a complete absence of such a force when using the traditional single plane or linearly oriented tennis racket.

Figure 4:
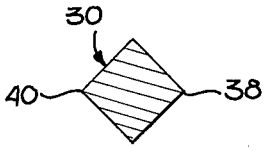
FIG. 4 is a cross-sectional elevational view of another embodiment of a racket illustrating its neck portion.

Referring now to FIG. 4, there is illustrated in a cross sectional view the design of a neck portion 30 of a solid type tennis racket such as a racket made of wood or synthetic resin material. This is in comparison to the neck portion 14 of the racket 10 which in FIGS. 1–3 is a metal racket having two parallel arms 34 and 36. The diamond shape cross section as shown in FIG. 4 provides an advantage by streamlining the leading surface 38 for purposes of reducing drag on the racket. Reducing drag allows for a faster and more powerful swing since less energy is wasted in the form of drag. It is, of course, understood that the opposite leading surface 40 is also streamlined so that an advantage is gained in both the forehand and backhand modes.

As already mentioned, the inventive racket which while disclosed for the purpose of playing tennis may be used for other sports as well to improve form, power and timing. It has been found that the racket automatically compensates by virtue of its offset handle and head portions so as to improve a users game without having to learn the game anew. As mentioned, the racket has a critical dimension range which provides the moment arm and thereby the force acting upon a users arm. This increases the players sensitivity to the position of the head portion relative to the users arm and grip and it allows the eye of the player to more easily follow the area of impact of the racket with a ball.

In play, when hitting a ball in the forehand mode, the racket head portion is swung backwardly with the face of the head portion tilting downwardly. As the player swings through a forehand, the head portion becomes vertical and essentially flat when contact is made with the ball. Because of the force created by the moment arm, the head portion will position the racket in a proper position during backswing and when contact is made with the ball at a slightly earlier time than would be the case with a traditionally shaped racket, the power being transmitted is at its maximum and the speed of the racket is also at its maximum since speed and power taper off markedly as a player continues through his swing. The same would be true when a player swings through a backhanded shot since in that position the head portion of the racket would be behind the handle portion and therefore would make contact with the ball slightly later than a traditional racket.

While it is obvious that there are other contributory factors to the power of a shot, such as the string material, the tension of the string, the composition of the racket, as well as the strength of an individual player, the present racket allows for more power through an increase in the speed of the swing. This is accomplished because the racket head portion will be tilted from a backswing position as it moves forwardly, thus creating less air resistance as it approaches contact with the ball, which in turn allows more speed to be built up prior to contact whether the shot is a forehand or a backhand. In a backhanded shot, the fact that the head portion is behind the handle portion allows the player additional time and distance to accelerate the racket prior to contact with the ball so that more power can be obtained when compared to a conventional racket. In addition, the inventive racket naturally flexes when ball contact is made and therefore tends to "whip" the ball, again adding to the power of a player. It can also be appreciated by virtue of the displacement of the head portion that a player's timing would be affected by reducing the difference in distances from the ball/head portion contact area and the pivot at the shoulder of a player. This will tend to make the forehand and backhand shots more similar and therefore more controllable.

When serving, the head portion is placed forward of the handle portion so as to naturally help hit the ball downwardly toward the service box on the other side of the net. Again, inherent in this is an increase of power and control.

What has been described is a racket for the playing of tennis which is relatively inexpensive, easy to manufacture, and yet advantageous in that it provides a player with more power, better timing and better form. It can be appreciated that in physical form the racket is only slightly different from existing tennis rackets, so that manufacture and assembly ought not to be appreciably different from that which exists today. Nevertheless a marked playing improvement is achieved.

I claim:

1. A sports racket comprising:

a head portion having an interlaced string material striking face;

a single handle portion for being gripped by a user; and a neck portion fixedly integral with and connecting the head and handle portions, wherein said striking face lies in a plane and said handle portion lies in a plane parallel to said striking face and being offset from said striking surface plane a distance within a range of $1\frac{1}{4}''$–$2''$ along line perpendicular to said striking face, said neck portion slopes at an angle of about 12° relative to said head portion, the length of said head portion is approximately 11";

the length of said handle portion is approximately $7\frac{3}{4}''$; and the length of said neck portion is approximately 8".

2. A sports racket as claimed in claim 1 wherein said spacing between said head portion plane and said handle portion center line is $1\frac{5}{8}''$.

* * * * *